United States Patent [19]

Fontenot, Sr.

[11] 4,237,660

[45] Dec. 9, 1980

[54] GASKET SEAT RESURFACER

[76] Inventor: John L. Fontenot, Sr., Rte. 2, Box 1605A, Westlake, La. 70669

[21] Appl. No.: 14,146

[22] Filed: Feb. 22, 1979

[51] Int. Cl.[3] ..... B24B 19/00

[52] U.S. Cl. ..... 51/241 VS; 408/83.5

[58] Field of Search ..... 51/241 VS, 209 R; 408/112, 83.5

[56] References Cited

U.S. PATENT DOCUMENTS

| | | | |
|---|---|---|---|
| 460,380 | 9/1891 | McGravey | 51/241 VS |
| 692,459 | 2/1902 | Langlois | 51/241 VS |
| 1,075,198 | 10/1913 | Crockatt | 408/112 |
| 1,268,617 | 6/1918 | Reed | 51/241 VS |
| 1,636,560 | 7/1927 | Hall | 51/241 VS |
| 1,765,968 | 6/1930 | Davey | 408/83.5 |
| 2,180,640 | 11/1939 | Mikalson | 51/241 VS |
| 2,232,340 | 2/1941 | Olson | 51/241 VS |
| 2,830,500 | 4/1958 | Schultis | 408/83.5 |
| 3,151,423 | 10/1964 | Beckman | 51/241 VS |

*Primary Examiner*—Othell M. Simpson
*Assistant Examiner*—Roscoe V. Parker
*Attorney, Agent, or Firm*—Clarence A. O'Brien; Harvey B. Jacobson

[57] ABSTRACT

The resurfacer includes an arbor attached to a grindstone. The arbor may be connected to a power tool to rotate the grindstone at a high rate of speed. A housing is disposed over the arbor and connected to a threaded adaptor. The size of the adaptor may be varied to conform to the valve being resurfaced. The adaptor threadedly engages the valve at which time the grindstone may be forced into engagement with the valve gasket seat. Also, small windows are incorporated in the adaptor walls in order to allow viewing of the grinding progress and venting of the grinding area to prevent pressure build-up.

6 Claims, 2 Drawing Figures

GASKET SEAT RESURFACER

BACKGROUND OF THE INVENTION

1. Field of the Invention

This invention relates to the field of grinders and especially to a grinding apparatus utilized to resurface the gasket seats of valves.

2. Description of the Prior Art

Various grinding mechanisms for valve seats, mating surfaces and the like have been suggested in the prior art. For instance, U.S. Pat. No. 2,180,640 shows a grinder for producing a smooth surface on the upper edges of fruit jars. The grinder includes a circular grindstone attached to one end of a rotatable, vertical shaft. The shaft extends through a housing which has a collar disposed about the jar neck. A spring is extended between the housing and the grind stone for forcing the grindstone into contact with the top edge of the jar. U.S. Pat. No. 2,232,340 to Olson, U.S. Pat. No. 3,151,423 to Beckman and U.S. Pat. No. 1,636,560 to Hall show grinding tools for resurfacing valve seats of internal combustion engines. Each of these valve grinders includes a power drive mechanism and a generally round grindstone.

SUMMARY OF THE INVENTION

The resurfacer of the present invention comprises an arbor rotatably disposed within an arbor housing and held fixed in alignment therewith. One end of the arbor is attached to a circular grindstone and the corresponding end of the arbor housing is removably attached to an arbor housing adaptor which threadedly engages with the periphery of the valve gasket seat to be reground. The arbor housing adaptor has a plurality of ports or windows circumferentially disposed therein so that the grinding progress may be observed in order that overgrinding of the gasket seat will not occur. The arbor is spring biased upwardly within the arbor housing and a free end of the arbor extends from the top of the housing for connection to a power drive tool such as a portable air motor. The spring biasing has the effect of forcing the grindstone away from the valve seat with the bias being overcome by a downward force produced by the user of the tool. In this manner, engagement of the grindstone and the valve gasket seat may be accurately controlled by the tool operator.

Accordingly, one object of the present invention is to provide a gasket seat resurfacer which is compact, economical to manufacture and easy to use.

A further object of the present invention is to provide a gasket seat resurfacer which produces a smooth, flat resurfaced gasket seat which is accurately ground in a plane orthogonal to the axis of the valving mechanism.

A further object of the present invention is to provide a gasket seat resurfacer which can be conveniently adapted to fit a large variety of gasket seats.

One still further object of the present invention is to provide a gasket seat resurfacer which can be quickly and easily disassembled to facilitate replacement of worn parts.

Another object of the present invention is to provide a gasket seat resurfacer which includes observation ports to allow the operator to observe the progress of the resurfacing process.

One further additional object of the present invention is to provide a gasket seat resurfacer in which the grinding stone is biased away from the gasket seat when the device is not actively grinding the gasket seat.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
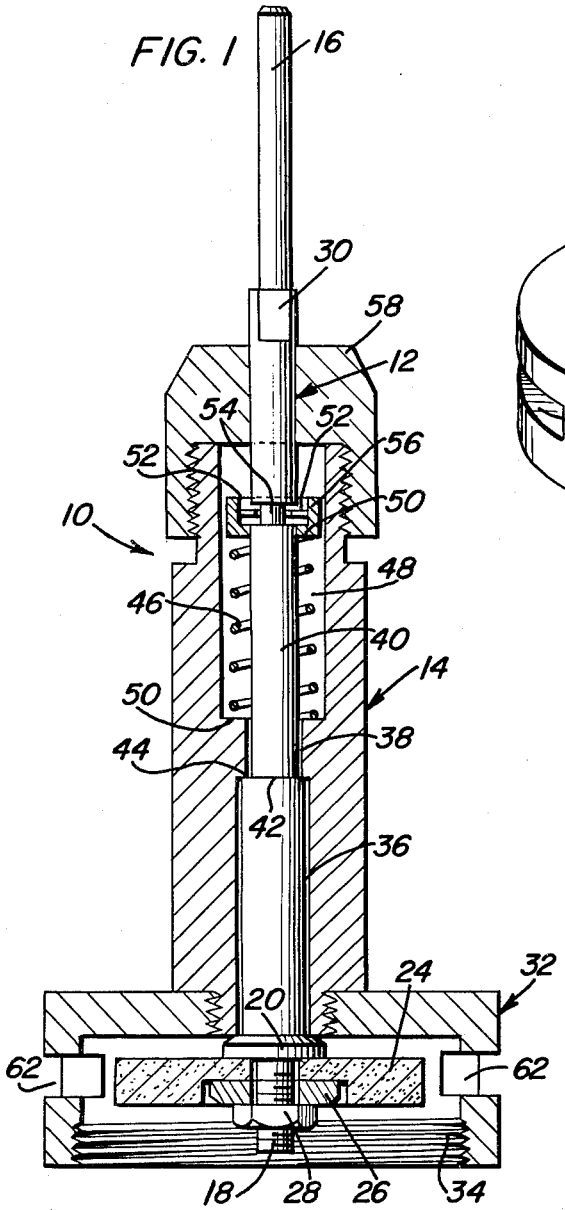
FIG. 1 is an elevational sectional view of the gasket seat resurfacer.
Figure 2:
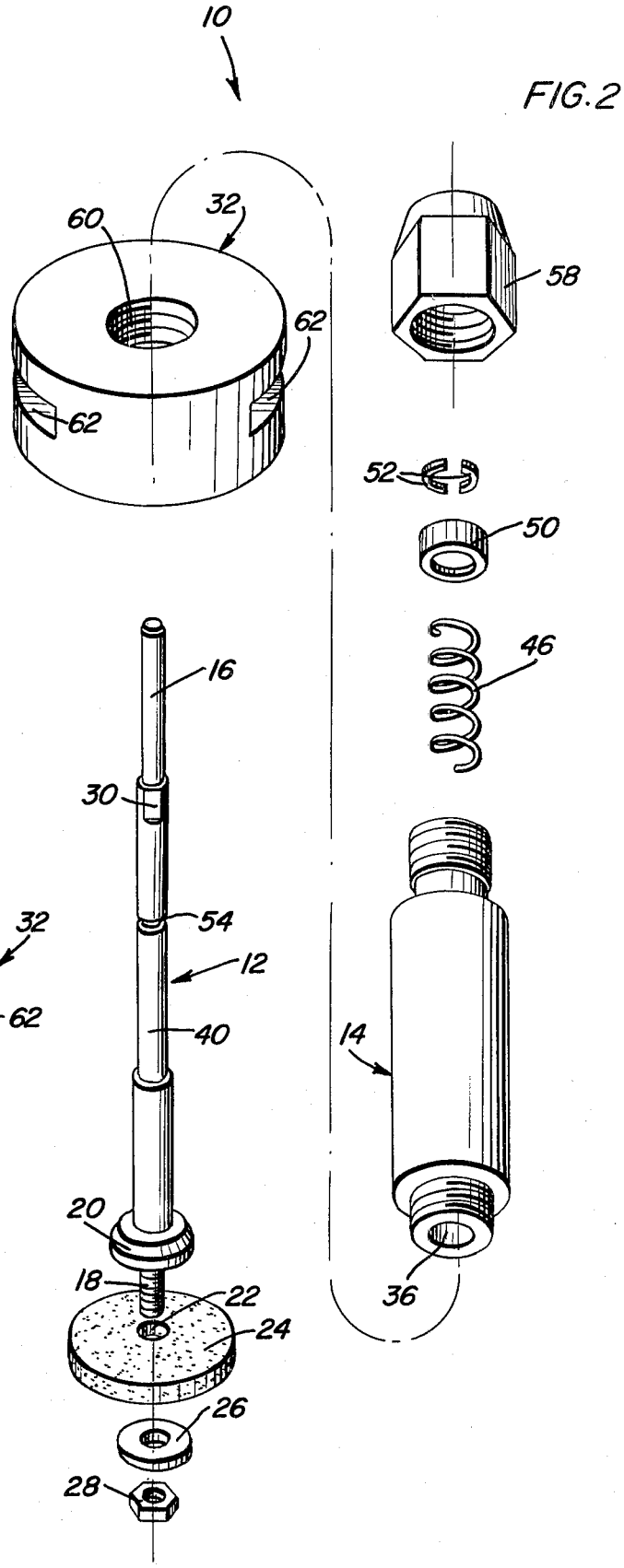
FIG. 2 is an exploded perspective view of the gasket seat resurfacer showing the discrete components thereof.

Now with reference to the drawings, the gasket seat resurfacer generally referred to by the reference numeral 10 will be described in detail.

The gasket seat resurfacer includes arbor 12 disposed in arbor housing 14. The arbor has a free end 16 which has a generally cylindrical configuration and is provided as a means of connection to the chuck of a power drive such as a portable electric or air motor having a rotary output. The opposite end of the arbor includes threaded connector 18 which extends axially of annular flange 20. The threaded connector is to be inserted in the central opening 22 of circular grindstone 24. A washer 26 is then disposed upon the threaded connector and a nut 28 holds the grindstone between washer 26 and flange 20. An axially extending flattened portion 30 is provided on each radially opposite side of the upper end of the arbor 12 to allow engagement between the arbor and a wrench in order that the arbor may be held against rotational motion while nut 28 is tightened or loosened with respect to the threaded connector 18. Alternatively, an end mill cutter may be attached to arbor 12 in place of the grindstone 24.

The arbor housing 14 encloses arbor 12 and is threadedly engaged with an arbor housing adaptor 32. The arbor housing adaptor in turn has threads 34 which are provided for connection to a valve housing or body upon which the worn gasket seat exists. A plurality of adaptors 32 may be used with a single housing 14 to allow use of the arbor and grindstone on a large variety of valve housings. The arbor housing 14 also contains a first cylindrical opening or bore 36 at the lower end of the housing in close proximity to the grindstone 24. Opening 36 serves as a bearing surface for the arbor 12 and produces proper alignment of the arbor with respect to the housing. Close proximity of the opening 36 to the grindstone containing end of the arbor is essential in order to reduce any wobble of the grindstone which might detrimentally affect the area being resurfaced, since the arbor should be kept as close as possible to a perpendicular relationship with respect to the gasket seat. Disposed immediately above opening 36 is a second smaller diameter opening 38 which surrounds the smaller diameter portion of the arbor 40. These reduced diameter sections result in cooperating shoulders 42 and 44 on the arbor and housing respectively. The shoulders 42 and 44 coact to limit axial movement of the arbor into the housing. The shoulders are held in engagement by spring 46 when the arbor and housing are in a quiescent state. The spring 46 is disposed in a large opening 48 within the housing. This larger opening ends in a shoulder 50 against which one end of spring 48 rests. The spring is placed in compression and the opposite end thereof is held by retainer ring 50 which is slidably disposed upon the arbor. The position of ring 50 is maintained by use of half ring retainers 52 which are disposed in circumferential groove 54 on arbor 12. The groove 54 inhibits axial movement of the half rings. The half rings are themselves held within that groove by the annular flange 56 which forms a part of retainer ring 50. These elements then coact to transfer the spring tension from spring 46 to the arbor 16 whereby annular flange 20 of the arbor is held proximate the lower portion of housing 14 unless an axial force opposite to that supplied by spring 46 is applied to the arbor 12. A retainer nut 58 is threadedly connected to the top of arbor housing 14 and surrounds the topmost portion of the arbor 12. The retainer nut aids in alignment of the arbor within the housing.

As discussed above, the arbor housing adaptor 32 is interchangeable so as to enable the use of the arbor with a variety of valve housings. In order to enhance this interchangeability, the annular flange 20 is designed to easily slide through the threaded opening 60 in each of the arbor housing adaptors 32.

Each arbor housing adaptor is provided with viewing windows 62 which allow visual communication with the grindstone 24 so that the progress of the work being done thereby may be monitored. Furthermore, the windows 62 serve as safety openings which prevent the build up of pressure developed within the device during operation thereof on a valve positioned in situ on a pressurized line. Any pressure build up may easily be vented through these openings.

In operation, it can easily be envisioned that the cylindrical free end 16 of the arbor is attached to the chuck of a power drive tool while the threads 34 of the arbor housing adaptor are connected to complementary threads on a valve housing. With the power tool turned on, a downward pressure is applied thereto which brings the grindstone 24 into engagement with the exposed gasket seat of the valve housing which is ground by contact with the grindstone. Periodically, the grindstone may be lifted from the gasket seat and the appearance of the seat may be checked through windows 62 until the work is satisfactorily completed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A grinding device for resurfacing gasket seats of valve bodies comprising an arbor having a longitudinally extending free end for engagement with a power drive tool and having an opposite end containing a threaded connector; an arbor housing for partially enclosing said arbor, and including a bearing surface disposed adjacent said threaded connector and slidably and rotatably receiving said arbor for aligning said arbor with said arbor housing; an arbor housing adaptor threadedly engaged with said arbor housing, said adaptor enclosing said threaded connector and terminating in a threaded aperture for connection to the valve body; a generally circular cutting means connected to said threaded connector of the arbor; and means connected between said arbor and said arbor housing for biasing said threaded connector toward said arbor housing, said means for biasing including a shoulder disposed within said arbor housing, a compression spring having one end thereof in engagement with said shoulder, and an arbor engagement device connected to the opposite end of said spring, said arbor engagement device including a circumferential extending groove on said arbor, a pair of half rings disposed in said groove and a retainer ring disposed over said half rings for holding said half rings in said groove and connected to said spring, said spring biasing said retainer over said half rings.

2. The device of claim 1 wherein said arbor includes a pair of radially opposed flattened surfaces thereon for providing a position at which a wrench may be attached to said arbor for allowing tightening of said threaded connector.

3. The device of claim 1 wherein said arbor housing adaptor includes at least one aperture for allowing visual communication between the outside of the arbor housing adaptor and said grindstone.

4. The device of claim 3 wherein said arbor further includes an arbor shoulder portion and said arbor housing further includes an arbor housing shoulder portion coacting with said arbor shoulder portion for limiting the axial movement of said arbor within said arbor housing.

5. The device of claim 4 and further including a retainer nut threadedly engaging the end of the said arbor housing opposite said threaded adaptor, said retainer nut including an aperture which accepts said arbor.

6. The device of claim 1 in combination with a valve body, said adaptor being threadedly engaged with complementary threads of said valve body, said valve body including a gasket seat contained upon a ridge above said complementary threads and disposed adjacent said grindstone.

* * * * *